US005199006A

United States Patent [19]

Ferrara

[11] Patent Number: 5,199,006

[45] Date of Patent: Mar. 30, 1993

[54] SYSTEM FOR THE MOVEMENT OF THE HANDS OF A CLOCK OR WATCH

[76] Inventor: Carlo Ferrara, 40 Via G. di Colloredo, I-00152 Roma RM, Italy

[21] Appl. No.: 857,158

[22] Filed: Mar. 25, 1992

[30] Foreign Application Priority Data

Mar. 27, 1991 [IT] Italy ..... 000201 A/91

[51] Int. Cl.[5] ..... G04B 19/00; G04C 21/00

[52] U.S. Cl. ..... 368/76; 368/80; 368/223

[58] Field of Search ..... 368/76, 80, 223, 228, 368/232

[56] References Cited

U.S. PATENT DOCUMENTS

| | | | |
|---|---|---|---|
| 2,221,413 | 11/1940 | Schanz | 368/76 |
| 3,852,949 | 12/1974 | Sayler | 368/76 |
| 3,956,879 | 5/1976 | Bailey | 368/223 |
| 4,103,484 | 8/1978 | Bailey | 368/76 |
| 4,161,098 | 7/1979 | Ingendahl | 368/76 |

FOREIGN PATENT DOCUMENTS

| | | |
|---|---|---|
| 0419421 | 9/1990 | European Pat. Off. . |
| 218946 | 1/1909 | Fed. Rep. of Germany . |
| 1001877 | 10/1951 | France . |
| 2450426 | 9/1980 | France . |

*Primary Examiner*—Vit W. Miska

*Attorney, Agent, or Firm*—Browdy and Neimark

[57] ABSTRACT

An analog type clock or watch having at least one hand and a scale of indicia showing time, comprising means for moving said at least one hand along a closed, non-circular path, having a first and a second straight section, parallel to each other and joined respectively at their ends by corresponding semicircular portions, so that the free end of said at least one hand travels along two straight sections and makes two 180 degree movements as it turns to indicate the time; said means comprising a motor element driven at a constant speed, said element being per se known, arranged so as to actuate a driven element to which the inner end of said hand is fixed; said driven element cooperating with guide means arranged to impart an alternately translatory and rotary movement to said driven element, so that the free end of said hand follows said closed, non-circular route, pointing in succession to marks indicating the time arranged on the dial of said clock or watch.

8 Claims, 7 Drawing Sheets

SYSTEM FOR THE MOVEMENT OF THE HANDS OF A CLOCK OR WATCH

BACKGROUND OF THE INVENTION

1. Field of the invention

The present invention relates to a system which causes the hand of a clock or watch to perform a new and original movement differing essentially from that of conventional clocks and watches with so-called "analog" time display.

2. Description of the Prior Art

As is known, in conventional clocks and watches of the analog type, the hands indicating the hours, the minutes and possibly the seconds move following a circular path, generally following a single scale of indicia on the dial of the clock itself.

SUMMARY OF THE INVENTION

According to the present invention a system is provided capable of causing the hand of a clock to move in a linear manner along a straight guide slot which is equidistant from opposite side portions of a scale indicating the time on the dial of said clock, and rotating when said hand reaches the top and bottom of said straight guide slot.

BRIEF DESCRIPTION OF THE DRAWINGS

The present invention will be better described below through the description of preferred embodiments thereof, given as a non-limiting example, and with reference to the enclosed figures, in which.

DESCRIPTION OF THE PREFERRED EMBODIMENTS

Figure 1:
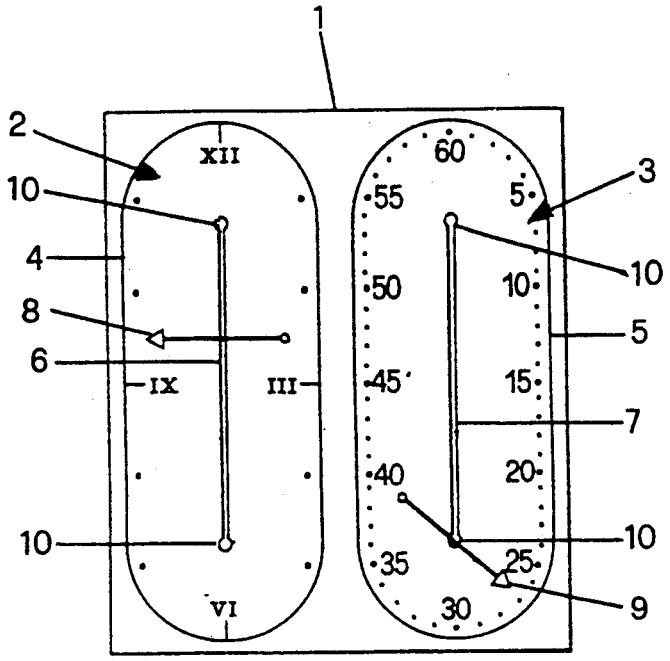
FIG. 1 is a plan view of a clock dial according to the present invention.

Reference is made to FIG. 1, in which is shown the dial 1 of a clock or watch using a system according to the present invention, said dial comprising two distinct and separate scales set side by side, of which a first scale, generally indicated with 2, relating to the hours and marked in part with Roman numerals and the rest with respective dots, and a second scale, generally indicated with 3, relating to the minutes, with numbers, for example, marked every five minutes and the remaining minutes indicated by respective dots.

The two scales 2 and 3 are externally bordered by respective outlines 4 and 5, having the same shape, made up of two straight, parallel, opposite sections, joined by two substantially semicircular sections, one at the top and one at the bottom.

It must be specified that, although in dial 1 of this embodiment of the invention scales with indicia relating to hours and minutes have been given, it is also possible to provide on the dial itself, as well as the scales mentioned above, scale for seconds next to that for hours or that for minutes, or alternatively the scale for hours alone.

Along the longitudinal axis line of each scale 2 and 3 a slot 6 and respectively 7 is made in the dial 1, said slot being of the same length as the straight sections of the outlines 4 and 5, each of said slots having a circular enlargement 10 in correspondence with both of the ends.

In each of the slots 6, 7 a hand 8, 9 runs, connected to a respective mechanism which will be described below and which causes said hand to move in a linear manner along the respective one of said slots, so as to indicate on its upward stroke the hours and the minutes marked on the left hand straight section, respectively, as seen in FIG. 1, of the outlines 4, 5, while during its downward stroke it indicates the hours and the minutes marked on the right hand straight section of said outlines, respectively. When the hand 8, 9 reaches the upper or lower end of the respective slot 6, 7, said mechanism causes it to rotate in the relative circular enlargement 10, so as to indicate the hours marked on the substantially semicircular upper or lower section of the respective outline 4, 5.

Figure 2:
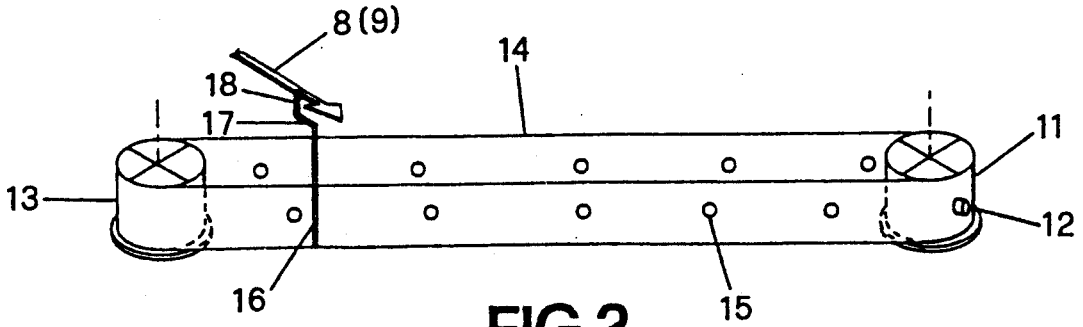
FIG. 2 is a perspective view of a mechanism for moving the hands of a clock or watch according to a first embodiment of the present invention.

With reference to FIG. 2, a description will now be given of an embodiment of the mechanism mentioned above for the movement of each of the hands 8 and 9 with said linear and rotating movements.

The mechanism mentioned above for the movement of each hand 8 and 9 comprises two rollers rotatingly fixed to the case of the clock in question, of which one is a driving roller, indicated with 11, having on its perimeter a series of equidistant pins of which only one is illustrated and indicated with 12, and the other a driven roller, indicated with 13. Between rollers 11 and 13 a flat circular belt 14 is positioned, along the longitudinal axis of which is made a sequence of holes 15, having a diameter slightly larger that that of the pins 12 on roller 11, placed at intervals equal to those between said pins, said holes 15 being suitable to be engaged by said pins 12 to cause the belt 14 to turn following rotation of the driving roller 11.

On the outer side of the belt 14, perpendicularly to its upper and lower edges, a rod 16 is fixed, having a first section 17 bent into a right angle, the length of said first section being equal to the radius of the rollers 11 and 13. From the free extremity of said first section there extends, perpendicularly and integral to said first section, a second section 18, parallel to the axis of the rollers 11 and 13, and engaged in the slot 6, 7. On the free extremity of said second section 18, the hand 8, 9 is fixed.

With the mechanism as above, the movement of the rod 16 carried by the straight sections of the belt 14 becomes the linear movement of the hand 8, 9 along the slot 6, 7, while when the rod 16 reaches the radius of the driven roller 13 perpendicular to the ascending section of said belt, or in correspondence with the edge of the radius of the driving roller 11 perpendicular to the descending section of said belt, which correspond, respectively, to the arrival of the hand 8, 9 at the upper or lower end of the slot 6, 7, said hand, as the movement of the belt 14 continues, respectively, around the driven roller 13 or around the driving roller 11, will make a turn, with the section 18 of the rod 16 turning in the upper or lower circular enlargement 10, in view of the fact that the length of section 17 of the rod 16 and the radius of the rollers 11 and 13 are equal, so that the section 18 of the rod 16, during the movement of belt 14 around the rollers 11 and 13, forms a continuation of the axis of one or the other roller.

For rotation of the driving roller 11 it is possible to provide a toothed wheel (not shown) keyed to the shaft of said roller, suitable to engage with a pinion keyed to the central pin for rotation of the hands in a conventional clock, or alternatively it is possible to provide a stepper motor for said roller.

Figure 3:
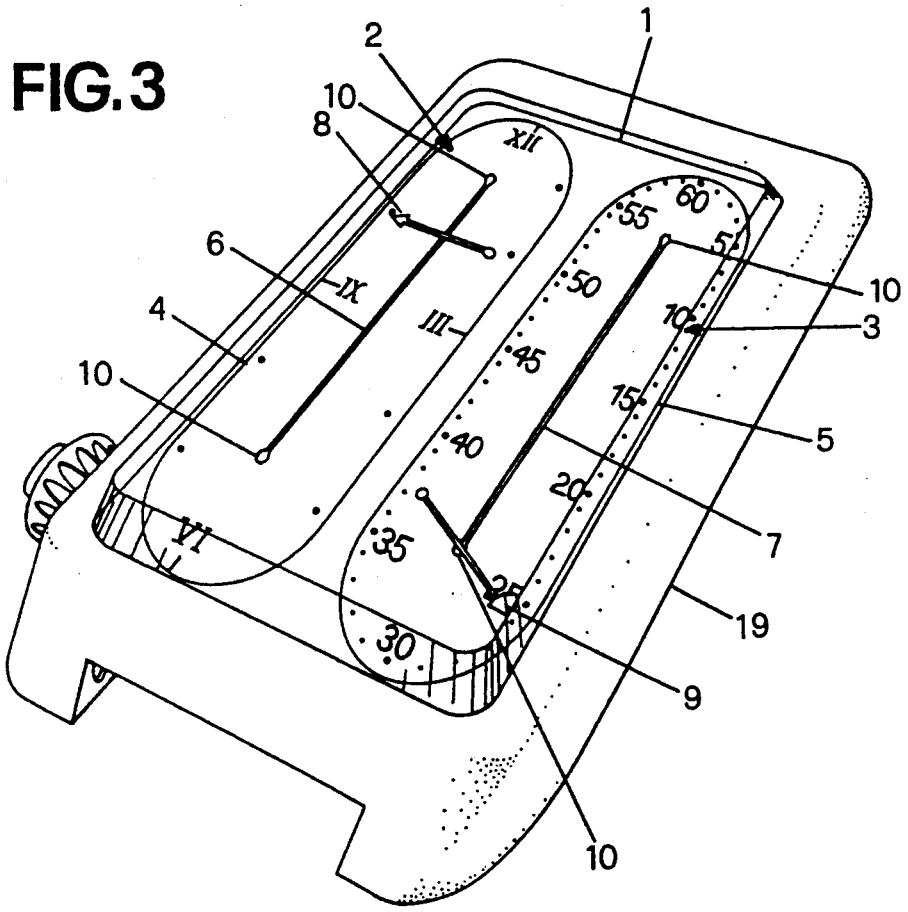
FIG. 3 is a perspective view of a wrist watch according to the present invention.

In FIG. 3 is shown, in a perspective view, the arrangement of a wrist watch according to the present invention, with a dial like the one shown in FIG. 1 and with two mechanisms (not shown), for example of the type shown in FIG. 2, incorporated inside the case, one of said mechanisms driving the hour hand 8 and the other driving the minute hand 9.

Now, with reference to FIGS. 4A, 4B, 5, 6, 7, 8 another embodiment for driving the hands of a clock or watch will be disclosed.

Figure 4A:
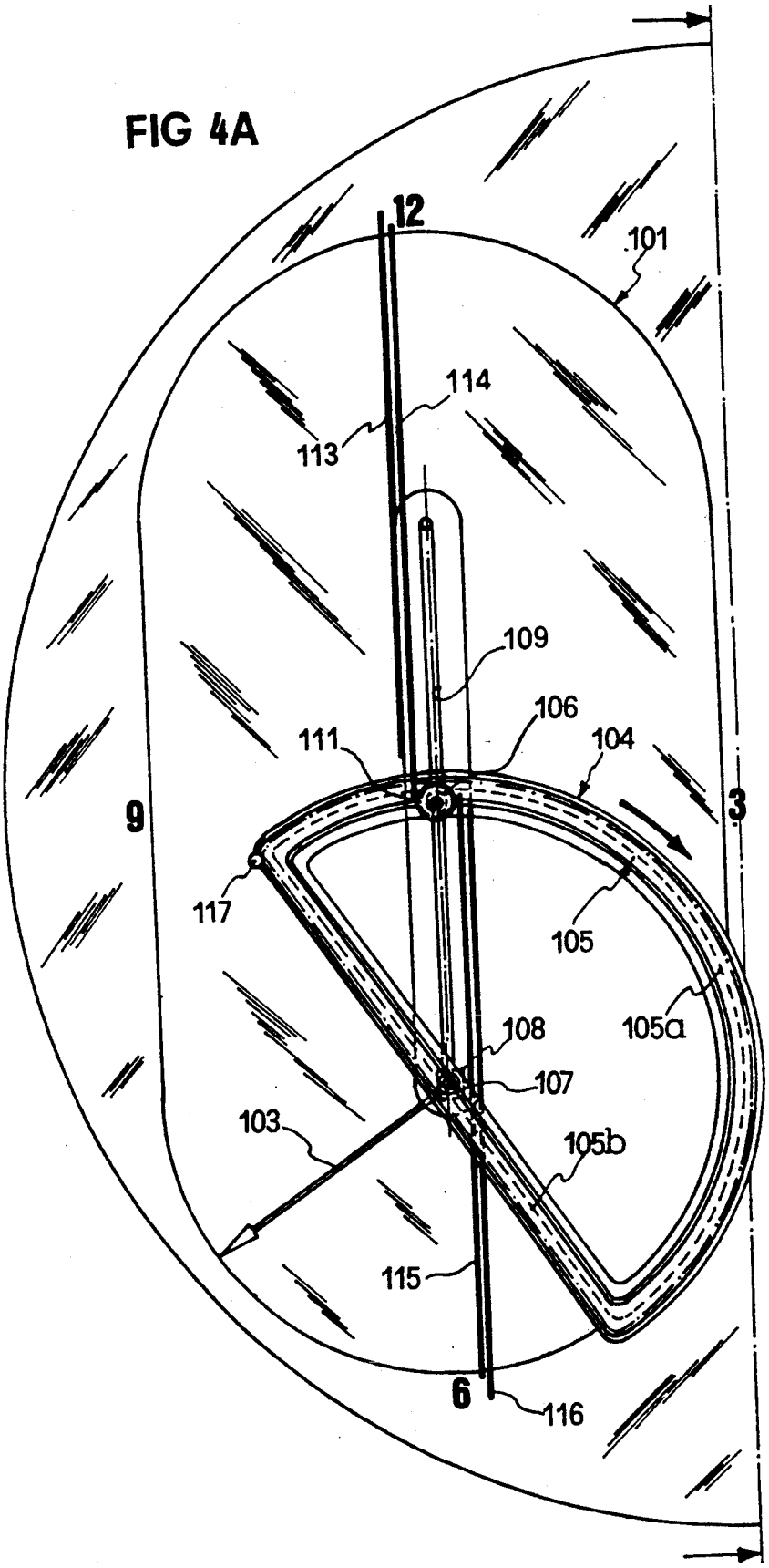
FIGS. 4A and 4B, taken together, show a second example of a mechanism for moving the hands of a clock or watch according to the invention.
Figure 4B:
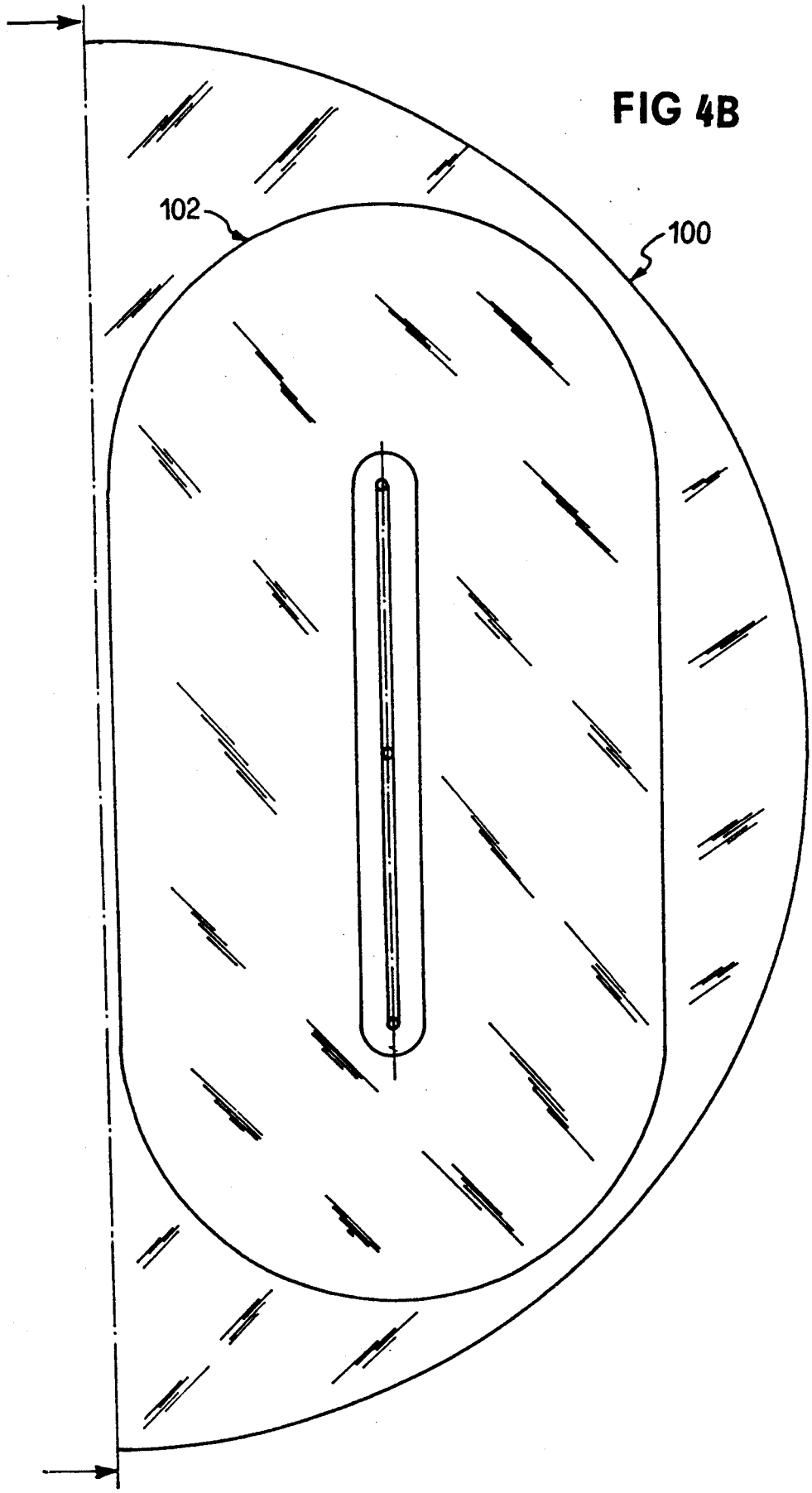

FIGS. 4A, 4B taken together show the general arrangement of a dial 100 having two scales 101, 102 equivalent to the scales 2, 3, shown in FIGS. 1 and 3 (for the sake of simplicity only the mechanism at the left of FIGS. 4A, 4B will be disclosed).

A hand 103 for indicating hours along the path or scale 102 is mounted on a half-wheel 104, the structure of which will be better disclosed hereinafter, having an internal toothing 105 meshing with a drive pinion 106 rotated in a conventional way as it is well known to a person skilled in the art.

The half-wheel 104 is pivoted in 107 on a movable carriage 108 that moves along a straight path 109.

The half-wheel 104 can perform either a rotational motion or a rectilinear motion according to whether the pinion 106 is meshing with the semicircular toothing 105A or with the straight toothing 105B.

When the pinion 104 engages the toothing 105A, the free end of the hand 103 follows the semicircular path at the top or bottom of the scale 101, while when the pinion 104 engages the toothing 105B, the free end of the hand 103 follows the straight part of the scale 101.

Figure 5:
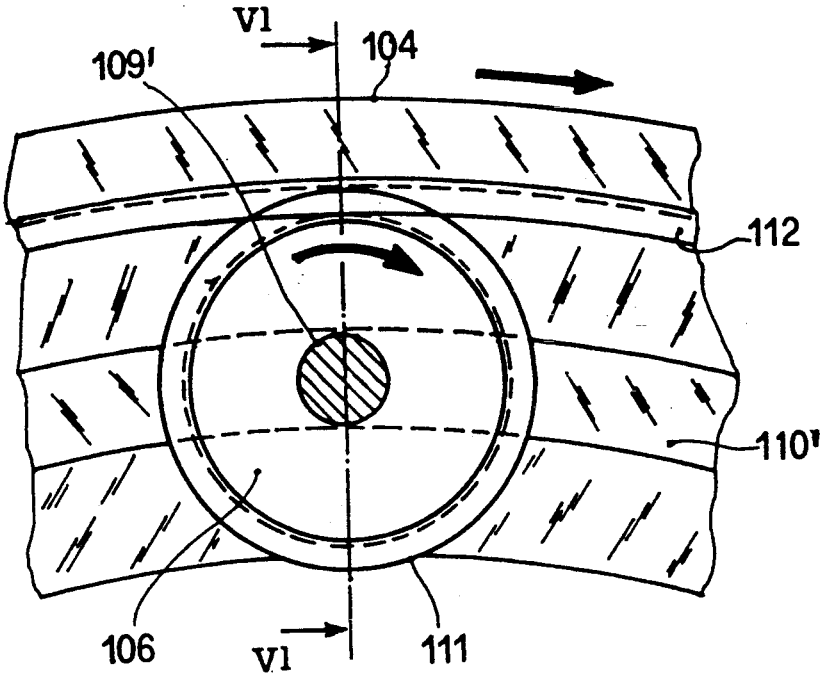
FIG. 5 shows a detail of the driving mechanism of FIG. 4A.
Figure 6:
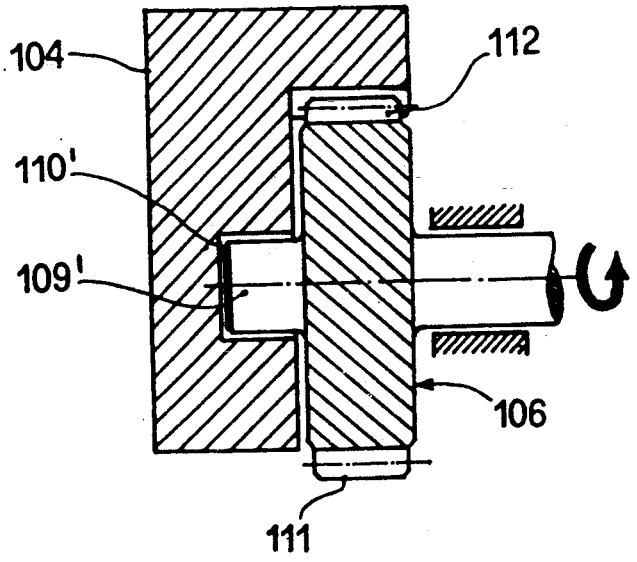
FIG. 6 shows a sectional view taken along lines VI—VI of FIG. 5.
Figure 7:
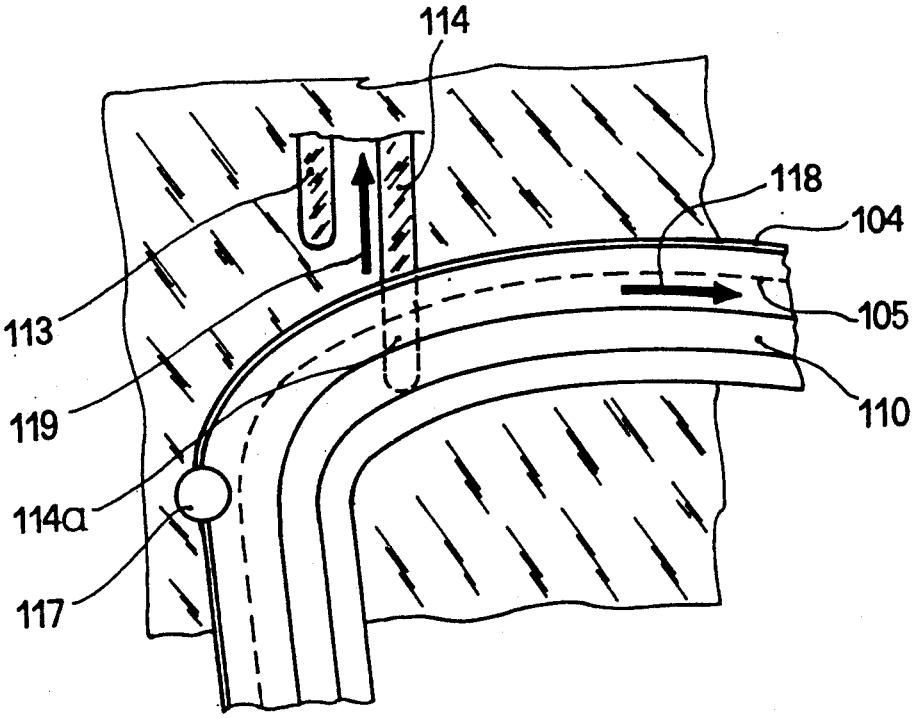
FIG. 7 shows another detail of the driving mechanism of FIG. 4A.

In order that the half-wheel 104 follows the intended motion, several mechanical constraints as shown in FIGS. 5 and 6 are provided as follows:

for maintaining the correct engagement with the pinion 106, the latter is provided with a retaining pin 109' that runs along a groove 110' present in the wheel 104. As can be more clearly seen in FIGS. 5 and 6, the toothing 111 of the pinion 106 meshes with the internal toothing 112 of the half-wheel 104.

With the cooperation of the toothings 111, 112, and the pin/groove arrangement 109'/110' a continuous engagement of the wheel 104 with the pinion 106 will be maintained.

This sole constraint, however, will not be sufficient for guiding the wheel 104. In order to assure the complete motion of the wheel 104, there is provided an arrangement comprising two pairs of guides 113, 114 and 115, 116, respectively that define between them a groove where a pin 117 can ride (see FIG. 7 for more details).

When the wheel 104 moves clockwise as shown by the arrow 118, at a given moment (i.e. at the end of the circular motion of the wheel 104) the pin 117 will engage the part 114A of the guide 114; at the same time, the pinion 106 will engage the rectilinear toothing 105B of the wheel 104, so that the wheel 104 (and the hand 103) will start a motion upwards as is shown by the arrow 119.

The same state of affairs will occur at the engagement by guide pin 117 of the guides 115, 116 when the wheel 104 from its topmost position will start to descent with the free end of the hand 103 following the right part of the path 101.

The wheel 104 is rotatably arranged, as mentioned above, on a sliding carriage 108. A pin 120 fostened to the wheel 104 passes through the carriage 108 and carries a hand 121 (103).

Figure 8:
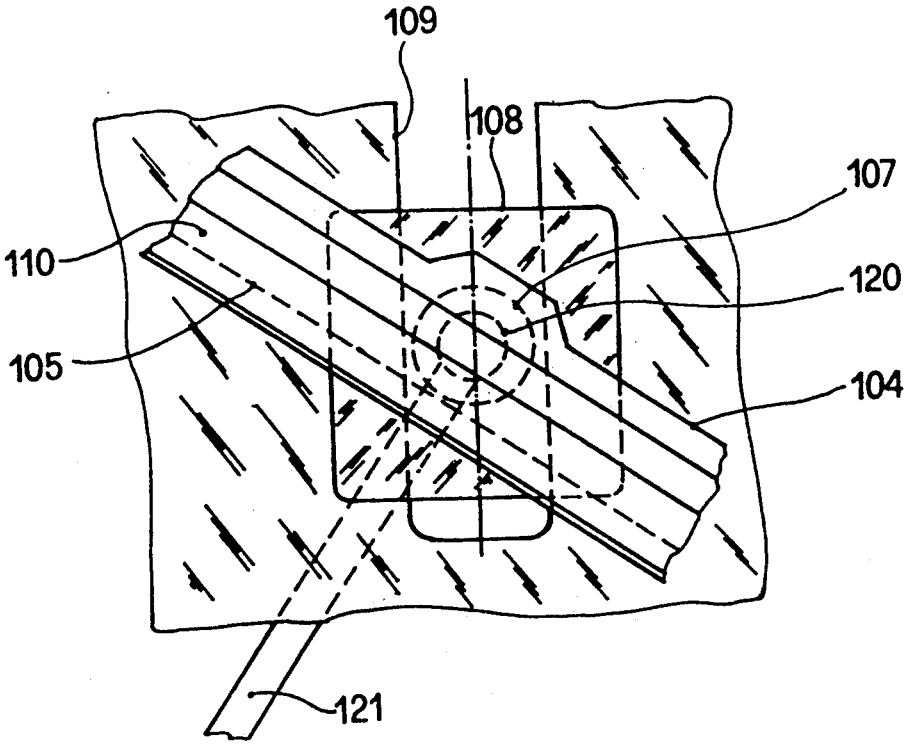
FIG. 8 shows another detail of the driving mechanism of FIG. 4A.
Figure 9:
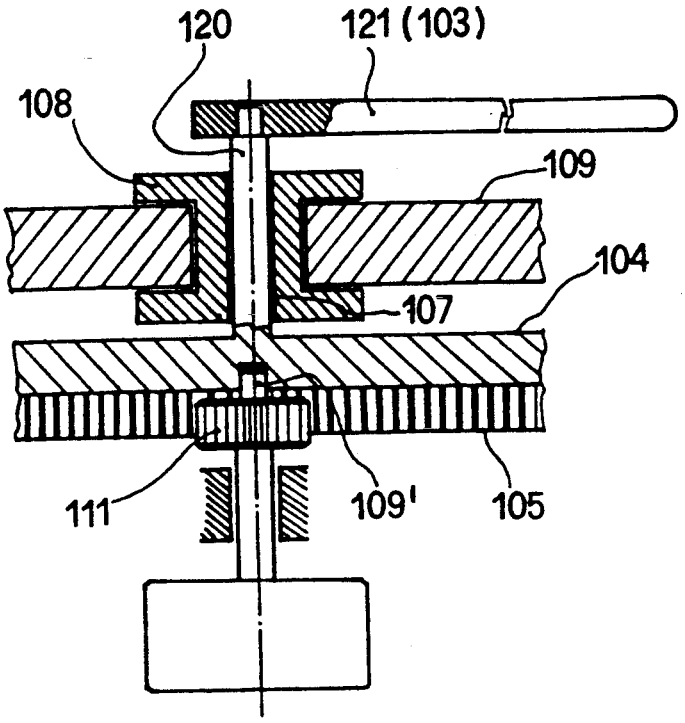
FIG. 9 shows a sectional view of the detail shown in FIG. 8.

This is better shown in FIGS. 8 and 9, where an enlarged representation of this structure is shown.

The operation of the mechanism thus disclosed should be clear. In the situation shown in fugre 4A, the carriage 108 is temporarily standing in the position shown, while the wheel 104 rotates through 180° in a clockwise direction, carrying with it the hand 103 (121).

When the toothing 105B becomes parallel to the path 109, the carriage 108 will slide along the path 109 rising towards the top of the drawing of FIGS. 4A, 4B, carrying the hand 103 (121) along a rectilinear path.

The converse occurs when the carriage 108 has reached its topmost position, where the wheel 104 will have its toothing 105A engaged by the pinion 106 performing thus a rotation through 180°. The cycle will repeat itself for the operation of a clock or watch.

What is claimed is:

1. An analog type clock or watch having a scale of indicia showing time, said clock or watch comprising:

at least one hand;

a closed, non-circular path having a first and a second straight section, parallel to each other and joined respectively at their ends by corresponding semicircular portions;

said at least one hand slidably engaged in a slot centered on said closed, non-circular path;

means for moving said at least one hand in said slot and turning said at least one hand when it reaches an end of said slot;

wherein a free end of said hand follows said closed non-circular path, pointing in succession to marks indicating the time arranged on a dial of said clock or watch when said at least one hand is moved in said slot by said means for moving;

wherein said means for moving comprises a continuous, flexible transmission element positioned between a driver roller and a driven roller; a rod, fixed to the outer surface of said flexible element perpendicularly to its upper and lower edges, said rod having on an upper part a first section bent at a right angle, the length of said first section being equal to the radius of said rollers, and a second section extending perpendicularly from a free end of said first section, said second section being parallel to the axis of said rollers, and slidably engaged in said slot, and said at least one hand being fixed to a free end of said second section.

2. An analog type clock or watch having a scale of indicia showing time, said clock or watch comprising:

at least one hand;

a closed, non-circular path having a first and a second straight section, parallel to each other and joined respectively at their ends by corresponding semicircular portions;

said at least one hand slidably engaged in a slot centered on said closed, non-circular path;

means for moving said at lest one hand in said slot and turning said at least one hand when it reaches an end of said slot;

wherein a free end of said hand follows said closed non-circular path, pointing in succession to marks indicating the time arranged on a dial of said clock or watch when said at least one hand is moved in said slot by said means for moving;

wherein said means for moving comprises a half-wheel having a toothing meshing with a drive pinion, said half-wheel being journalled on a journal carried by a sliding carriage movable along said slot;

said half-wheel also carrying a pin supporting said at least one hand;

wherein when said half-wheel meshes with said drive pinion along a semicircular part of said toothing, said at least one hand performs a half-turn motion, while when said half-wheel meshes with said drive pinion along a rectilinear part of said toothing, said at least one hand runs along a straight path parallel to said slot.

3. An analog type clock or watch according to claim 1, wherein said driving roller is rotatably actuated by clock mechanism.

4. An analog type clock or watch according to claim 1, wherein said drive pinion is rotatably actuated by a clock mechanism.

5. An analog type clock or watch according to claim 1, comprising two distinct and separate scales of indicia, one for the hours and one for the minutes.

6. An analog type clock or watch according to claim 2, comprising two distinct and separate scales of indicia, one for the hours and one for the minutes.

7. An analog type clock or watch according to claim 1, comprising an additional means for moving a second hand along a closed, non-circular path identical to said means for moving said at least one hand.

8. An analog type clock or watch according to claim 2, comprising an additional means for moving a second hand along a closed, non-circular path identical to said means for moving said at least one hand.

* * * * *